US010507353B2

(12) United States Patent
McBride

(10) Patent No.: US 10,507,353 B2
(45) Date of Patent: Dec. 17, 2019

(54) ERGONOMIC STRAP FOR WEIGHT LIFTING AND FITNESS EXERCISES

(71) Applicant: James McBride, Coquitlam (CA)

(72) Inventor: James McBride, Coquitlam (CA)

( * ) Notice: Subject to any disclaimer, the term of this patent is extended or adjusted under 35 U.S.C. 154(b) by 0 days.

(21) Appl. No.: 15/947,066

(22) Filed: Apr. 6, 2018

(65) Prior Publication Data

US 2018/0353796 A1 Dec. 13, 2018

(30) Foreign Application Priority Data

Jun. 7, 2017 (CA) ..... 2970187

(51) Int. Cl.
*A63B 21/00* (2006.01)
*A63B 21/072* (2006.01)

(52) U.S. Cl.
CPC ..... *A63B 21/4021* (2015.10); *A63B 21/4019* (2015.10); *A63B 21/0724* (2013.01); *A63B 2209/10* (2013.01); *A63B 2225/09* (2013.01)

(58) Field of Classification Search
CPC . A63B 21/4021; A63B 21/4019; A63B 21/00; A63B 2225/09; A63B 2209/10; A63B 21/0724
See application file for complete search history.

(56) References Cited

U.S. PATENT DOCUMENTS 5,295,269 A * 3/1994 Ballard ..... A41D 19/01523 2/161.1
5,350,343 A * 9/1994 DaSilva ..... A41D 13/082 2/20
5,634,213 A 6/1997 Grover
5,745,920 A * 5/1998 Olivier ..... A63B 21/4019 2/161.1
5,813,950 A * 9/1998 Parker ..... A41D 13/082 2/20
6,146,319 A 11/2000 Tarail
6,168,556 B1 * 1/2001 Saavedra ..... A63B 21/4019 224/220
6,564,385 B2 * 5/2003 McCarthy ..... A63B 21/4019 2/16
7,004,889 B2 2/2006 McBride
7,736,284 B1 6/2010 Andrews
7,785,244 B2 8/2010 Hetrick
8,777,816 B2 * 7/2014 Grafman ..... A63B 71/14 482/104
9,999,266 B2 * 6/2018 Harris ..... A41D 19/0037
(Continued)

*Primary Examiner* — Andrew S Lo
(74) *Attorney, Agent, or Firm* — Frederick Kaufman Inc.

(57) ABSTRACT

This invention relates to an ergonomic strap for weight lifting and fitness exercises, comprising a first strap for encircling a wrist, a second soft strap, facing the wrist, attached to the first strap, a third strap incorporating a Velcro fabric, attached externally to the first strap and a fourth strap secured to the first and third straps under an inclination of α45 degrees; such an inclination precludes the portion of the fourth strap, facing a palm, during wrapping around a weight lifting bar, to form several consecutive loops, so that a succeeding loop does not overlap a preceding loop, thereby a helical wrapping is resulting; i.e. the inclination of the fourth strap at α45 degrees, prevents a part of the fourth strap that is closest to the wrist, from overlapping itself.

1 Claim, 6 Drawing Sheets

(56) References Cited

U.S. PATENT DOCUMENTS

| | | | | |
|---|---|---|---|---|
| 2005/0075227 | A1* | 4/2005 | Emick | A63B 21/4001 482/139 |
| 2005/0255973 | A1 | 11/2005 | Ward | |
| 2008/0120755 | A1* | 5/2008 | Ingram | A63B 21/4001 2/20 |
| 2008/0125295 | A1* | 5/2008 | Ingram | A63B 21/40 482/139 |
| 2013/0331236 | A1* | 12/2013 | Moss | A63B 21/065 482/93 |
| 2014/0066272 | A1* | 3/2014 | Ingram | A63B 21/40 482/139 |
| 2015/0057133 | A1 | 2/2015 | Nguyen | |
| 2016/0023037 | A1* | 1/2016 | Schiek | A63B 21/0783 482/92 |

* cited by examiner

ERGONOMIC STRAP FOR WEIGHT LIFTING AND FITNESS EXERCISES

CROSS-REFERENCE TO RELATED APPLICATION

This application claims the benefit of priority on the basis of Canadian Patent Application No. 2,970,187 filed on Jun. 7, 2017

I. BACKGROUND OF THE INVENTION

1. Field of the Invention

The present invention relates, in general, to straps for weight lifting and other fitness training and, more particularly, to an ergonomic strap for weight lifting and fitness exercises.

2. Description of the Related Art

Straps for weight lifting and other fitness training are designed to enhance 1) a first grip between several consecutive loops of a strap wound around a weight lifting bar and that bar and 2) a second grip between several consecutive loops of a strap wound around a bar and a closed palm of a user. The essential disadvantage of the known types of straps for weight lifting and other fitness training resides in an uncomfortable positioning of the strap to be wound about a weight lifting bar or alike, with respect to a hand contiguous to that strap, namely a curling thumb and flexing fingers of that hand.

II. OBJECTIVES AND SUMMARY OF THE INVENTION

A first objective of the present invention is to conceive a strap having a design with a components arrangement that enables the users to interact with that strap in a comfortable, secure and efficient manner.

A second objective of the present invention is to devise a durable-reliable and size adaptable strap.

A third objective of the present invention is to devise a simple strap which requires reduced costs of manufacture.

Broadly stating, the ergonomic strap for weight lifting and fitness exercises, conform the present invention, which is designed for right and for left hand, a right hand design being a mirror image of a left hand design and, comprises, in combination, a first strap, made of a durable and flexible material with one top rough surface and one bottom rough surface and having a length suitable to form a loop encompassing a wrist of a user and to extend somewhat beyond; a rigid buckle throughout which one end portion of the first strap is inserted and then folded back upon itself and stitched;

a second strap made of a soft material constitutes an internal, cushioning component of the ergonomic strap; the second strap has a width commensurate with a width of the first strap and a length for enabling to circumferentially surround and directly contact the wrist; the second strap is superposed on the first strap and stitched together;

a third strap, basically congruent with the first strap, starting in proximity of the rigid buckle and extends along the first strap; the third strap is superimposed on the first strap, the third strap and the first strap being stitched together at their extremities; the third strap is constituted by a fabric strip with hooks and loops (Velcro) and includes a first, relatively long zone starting in proximity of the rigid buckle and formed by loops, followed by a second, relatively short zone formed by hooks; the third strap, being constituted by the fabric strip with hooks and loops, is used to keep the ergonomic strap secured to the wrist during use, or assembled during storage; and a fourth strap for wrapping in a helical manner about a weight lifting bar or alike, thus covering a zone commensurate with a width of a palm of a usual user is made of a durable and flexible material with rough, opposite/external sides; the fourth strap has one end inserted between and stitched to the first and the third straps; the fourth strap is so positioned with respect to the first strap as to be, during a spiral wounding about the weight lifting bar, easily engageable by a thumb and a juxtapositioned index finger of a user, a position which corresponds to an inclination of $\alpha 45$ degrees of the fourth strap with respect to the first strap; such an inclination precludes the portion of the fourth strap, that faces a palm of a user, during wrapping around the weight lifting bar, to form several consecutive loops, so that a succeeding loop does not overlap a preceding loop, thereby a helical wrapping is resulting; i.e. the inclination of fourth strap at $\alpha 45$ degrees, instead of a usual inclination at 90 degrees, prevents a part of the fourth strap that is closest to the wrist, from overlapping itself over the first loop when wrapped around the weight lifting bar; due to a rough contact between the loops, namely by the one of said pair of rough opposite sides and a weight lifting bar, an enhanced friction engagement occurs; simultaneously, said another one of said pair of rough opposite sides, which is in direct contact with the palm of a user, enhances a handgrip; and a thin, narrow, elastic band, being transversely positioned on the bottom rough surface of the first strap and having extremities attached to the first strap, is situated in a zone corresponding to an intersection of the long zone and the short zone; when the ergonomic strap is not in use and already assembled, an end of the fourth strap is inserted through and secured in a space available between the thin, narrow, elastic band and the bottom rough surface.

III. BRIEF DESCRIPTION OF THE DRAWINGS

The subject matter of the present invention is particularly pointed out and distinctively claimed in the concluding portion of this specification. The invention, however, both in structure and operation, may be better understood by reference to the following description taken in conjunction with the subjoined claim and the accompanying drawings of which:

IV. DESCRIPTION OF THE PREFERRED EMBODIMENT

Figure 1:
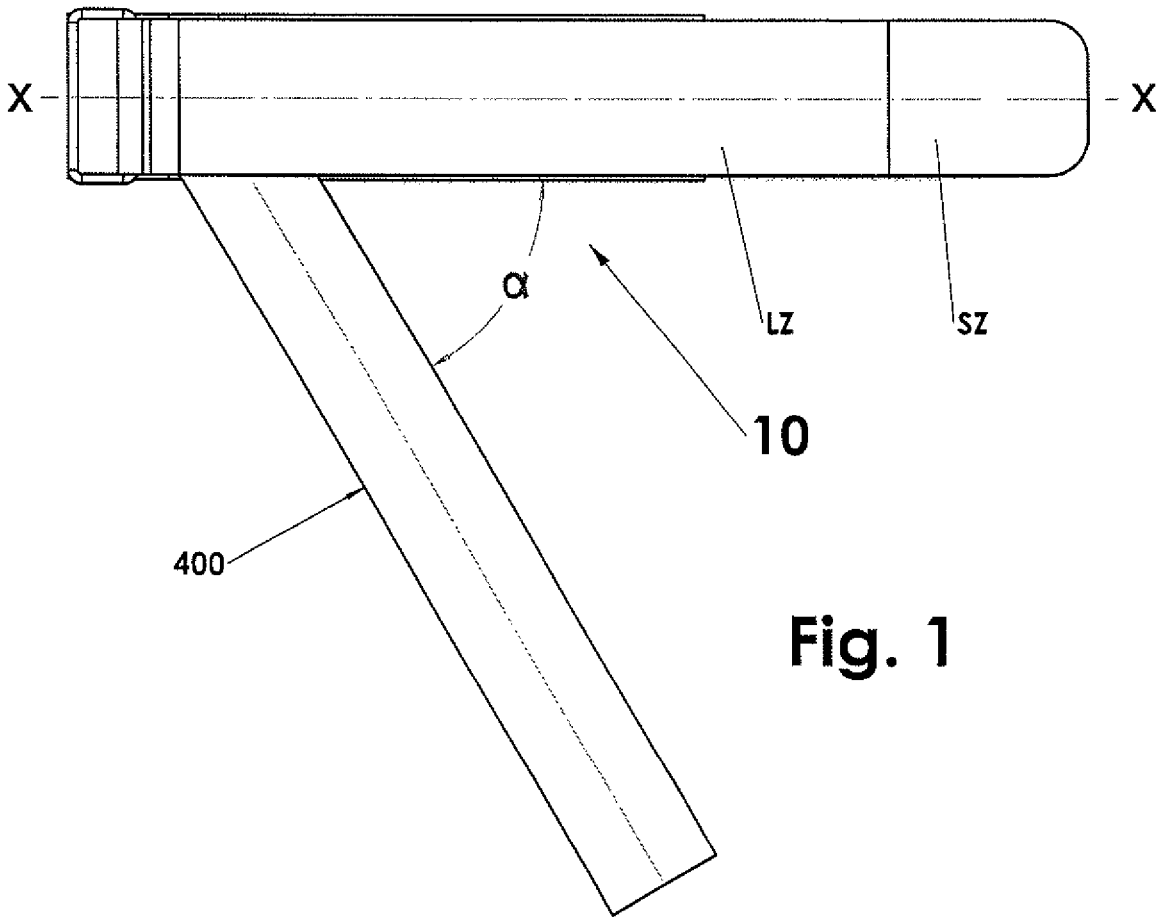
FIG. 1 illustrates a spread out of ergonomic strap, viewed from the top.
Figure 2:
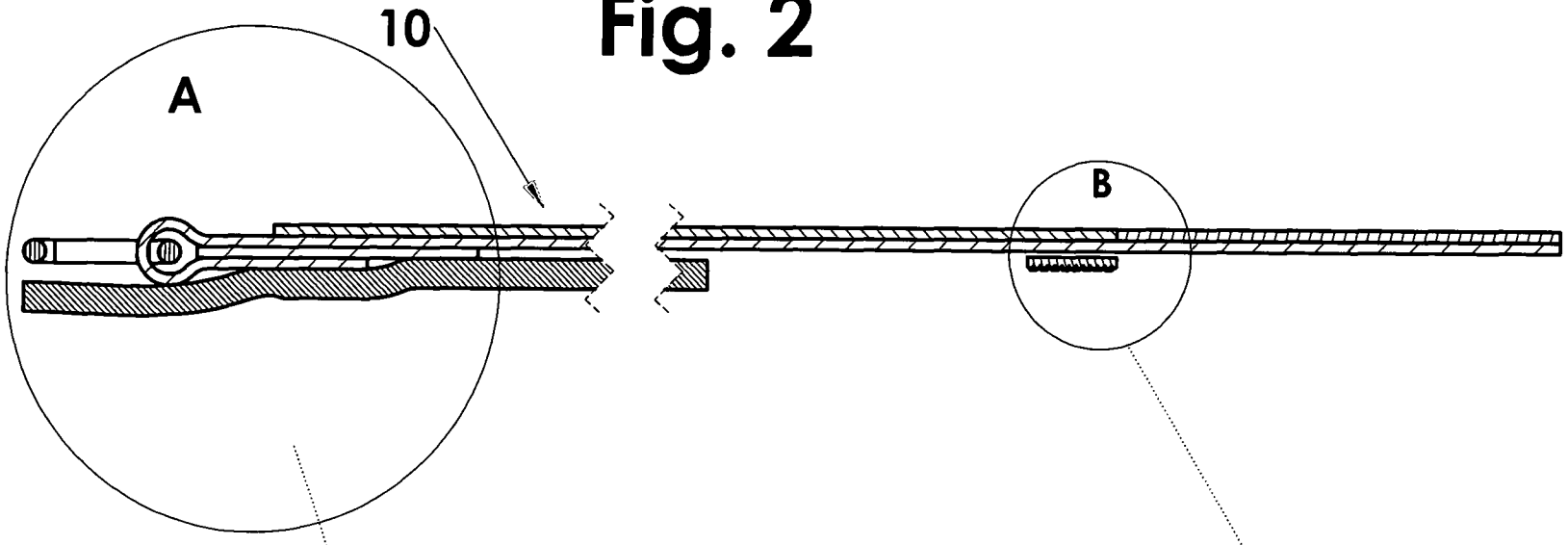
FIG. 2 illustrates a longitudinal cross-section along line X-X shown in FIG. 1.
Figure 4:
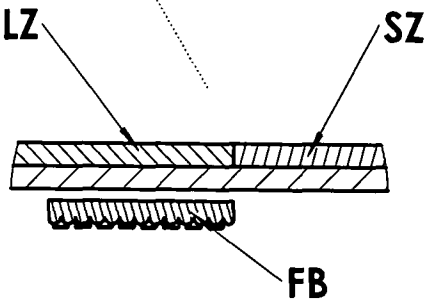
FIG. 4 illustrates an enlarged view of zone B, depicted in FIG. 2.
Figure 3:
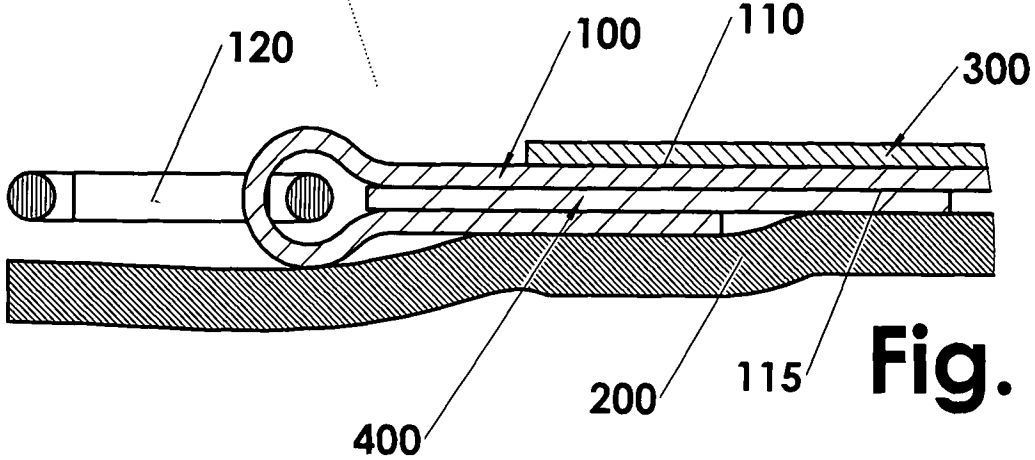
FIG. 3 illustrates an enlarged view of zone A, depicted in FIG. 2.
Figure 5:
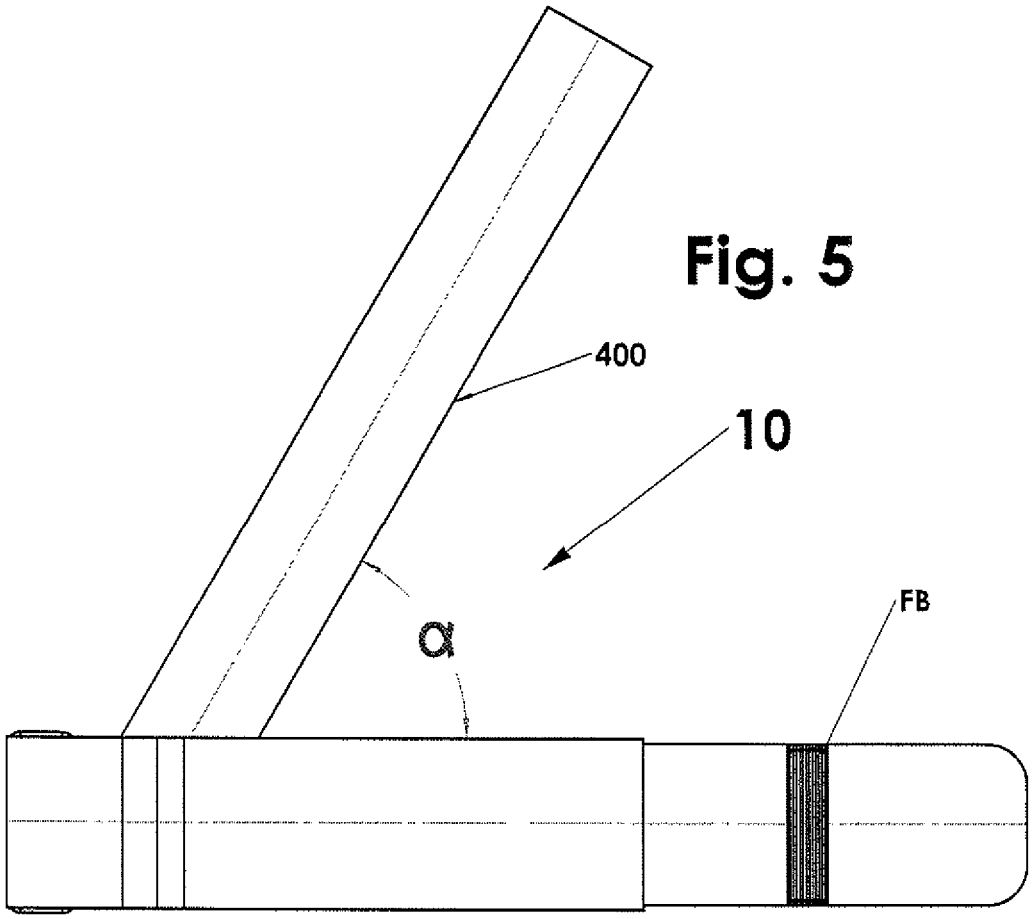
FIG. 5 illustrates the underside view of FIG. 1.
Figure 6:
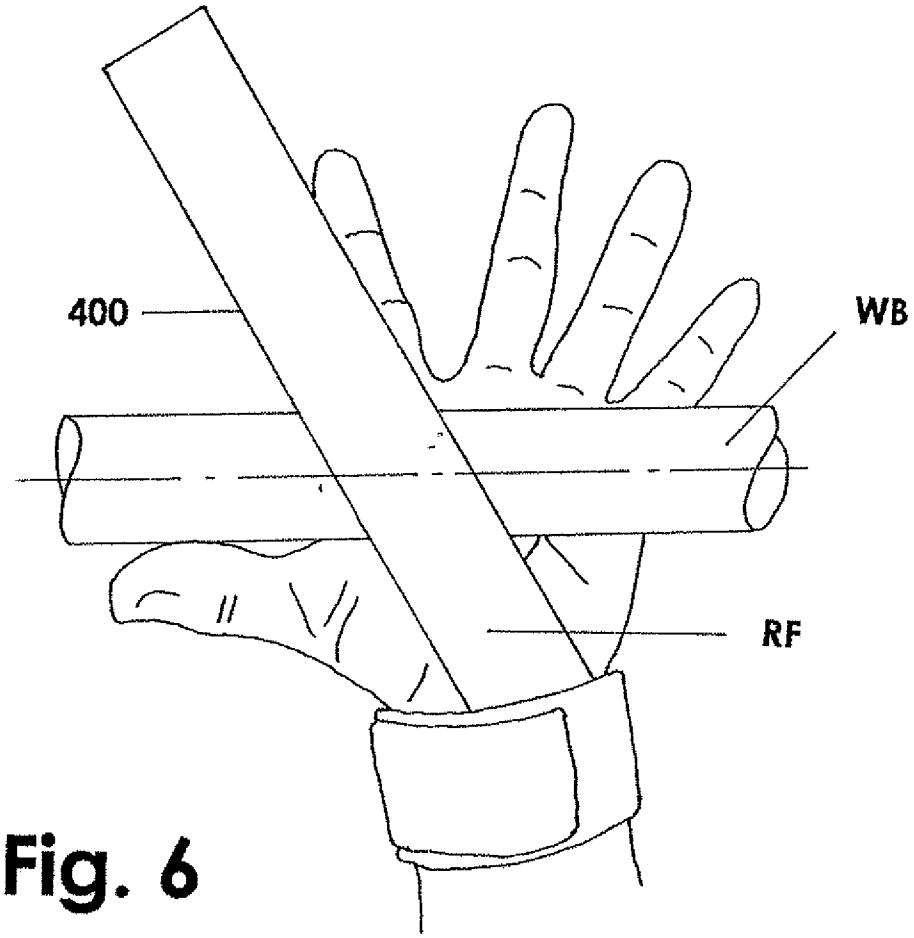
FIG. 6 shows the ergonomic strap, already attached to wrist, but before wrapping.
Figure 7:
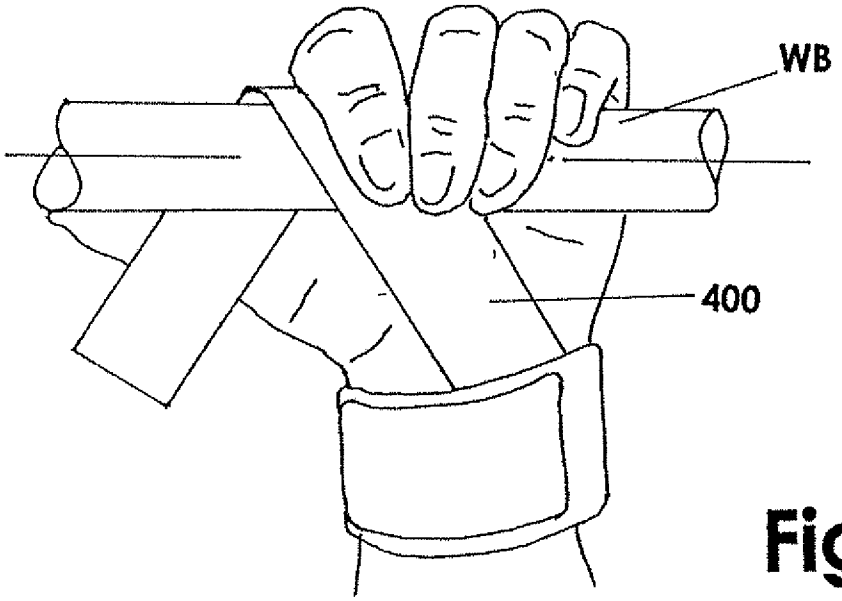
FIG. 7 shows the ergonomic strap with the first loop wrapped around the weight lifting bar.
Figure 8:
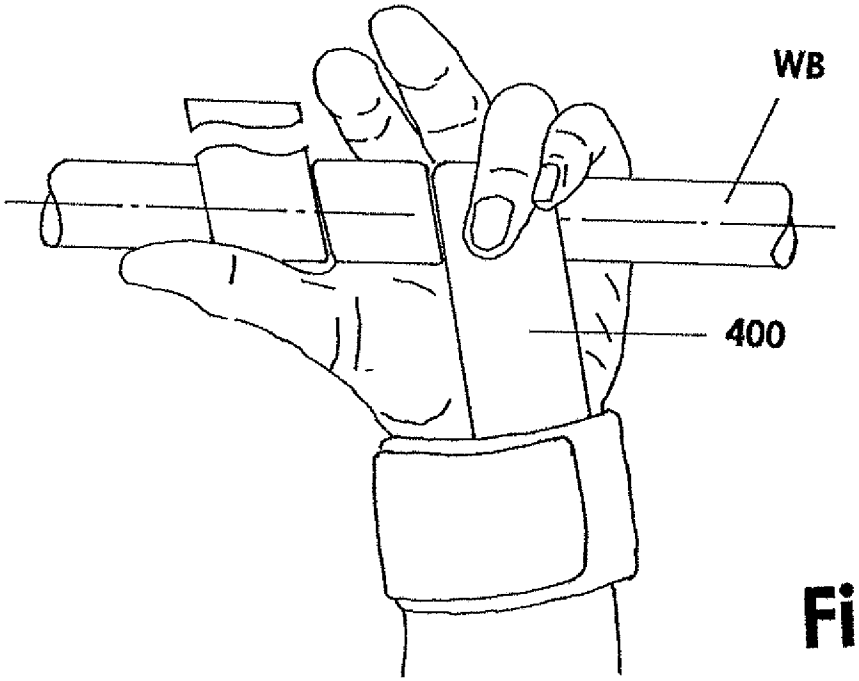
FIG. 8 shows the ergonomic strap with several, consecutive loops wrapped around the weight lifting bar.

The present invention relates to an ERGONOMIC STRAP FOR WEIGHT LIFTING AND FITNESS EXERCISES, further named, for the simplification of the specification, "ergonomic strap", and generally designated by reference numeral 10.

Ergonomic strap 10 that is designed and produced for right and for left hand, a right hand design being a mirror image of a left hand design and, conversely, comprises, in combination, a first strap 100, made of a durable and flexible material and having a top rough surface 110 and a bottom rough surface 115; first strap 100 has a width of approximately 2 in. and a length, first, suitable to form a loop encompassing a wrist of a user and, second, to extend beyond; a rigid buckle 120 for inserting throughout one end portion of first strap 100; after the one end portion of first strap 100 passes through rigid buckle 120, it is folded back upon itself and stitched;

a second strap 200, made of a soft material, such as, for example, neoprene, constitutes an internal, cushioning component of ergonomic strap 10; second strap 200 has a width commensurate with the width of first strap 100 and a length for enabling to circumferentially surround and directly contact the wrist; second strap 200 is superposed on first strap 100; first strap 100 and second strip 200 are fasten together with stitches (not shown);

a third strap 300, basically congruent with first strap 100, is starting in proximity of rigid buckle 120 and extends along first strap 100; third strap 300 is superimposed on top rough surface 110 of first strap 100, third strap 300 and first strap 100 being fasten together, at their extremities, with stitches (not shown); third strap 300 is constituted by a fabric strip with hooks and loops (Velcro) and includes a first, relatively long zone LZ starting in proximity of rigid buckle 120 and formed by loops, followed by a second, relatively short zone SZ formed by hooks; third strap 300, constituted by a fabric strip with hooks and loops, is used to keep ergonomic strap 10 secured to the wrist during use, or assembled during storage; and a fourth strap 400 having a width of approximately 1.5 in. and a convenient length for enabling to wrap in a helical manner about a weight lifting bar or alike WB, thus covering a zone commensurate with a width of a palm of a usual user and being made of a durable and flexible material with rough, opposite/external sides RF; fourth strap 400 having one end inserted between and secured with stitches (not shown) to first and third straps 100 and 300; fourth strap 400 being so positioned with respect to first strap 100 as to be, during a spiral wounding about weight lifting bar WB, easily engageable by a thumb and a juxtapositioned index finger of a user, a position which corresponds to an inclination of α45 degrees of fourth strap 400 with respect to first strap 100; such an inclination precludes the portion of fourth strap 400, that faces a palm of a user, during wrapping around a weight lifting bar, to form several consecutive loops, so that a succeeding loop does not overlap a preceding loop, thereby a helical wrapping is resulting; i.e. the inclination of strap 400 at α45, instead of a usual inclination at 90 degrees, prevents a part of the strap 400 that is closest to the wrist, from overlapping itself over the first loop when wrapped around weight lifting bar WB; due to a rough contact between the loops, namely by one of the pair of rough opposite sides RF and weight lifting bar WB, an enhanced friction engagement occurs; simultaneously, another one of the pair of rough opposite sides RF, that is in direct contact with the palm of a user, enables an improved handgrip; and a thin, narrow, elastic band FB, being transversely positioned on bottom rough surface 115 of first strap 100, and having extremities attached to first strap 100, is situated in a zone corresponding to an intersection of long zone LZ and short zone SZ; when ergonomic strap 10 is not in use and already assembled, an end of fourth strap 400 is inserted through and secured in a space available between thin, narrow, elastic band FB and bottom rough surface 115.

As required, a detailed embodiment of the present invention is disclosed herein; however, it is to be understood that the disclosed embodiment is merely exemplary of the invention which may be embodied in various forms. Therefore, specific structural and functional details are not to be interpreted as limiting, but merely as a basis for the claims and as representative basis for teaching one skilled in the art to variously employ the present invention in virtually any appropriately detailed structure.

The embodiment of the invention, in which an exclusive property or privilege are claimed, are defined as follows:

1. An ergonomic strap for weight lifting and fitness exercises, designed for right and left hands, a right hand design being a mirror image of a left hand design and, comprising, in combination, a first strap made of a durable and flexible material with one top and one bottom rough surfaces and having a length configured to form a loop encompassing a wrist of a user and to extend beyond; a rigid buckle through which one end portion of said first strap is inserted and then folded back upon itself and stitched;

a second strap made of a soft material and constituting an internal, cushioning component of said ergonomic strap; said second strap having a width commensurate with a width of said first strap and a length for enabling to circumferentially surround and directly contact the wrist; said second strap being superposed on said first strap and stitched together;

a third strap, congruent with said first strap, starting in proximity of said rigid buckle and extending along said first strap; said third strap being superimposed on said first strap, said third strap and said first strap being stitched together at their extremities; said third strap being constituted by a fabric strip with hooks and loops and includes a first, long zone starting in proximity of said rigid buckle and formed by loops, followed by a second, short zone formed by hooks; said third strap, being constituted by said fabric strip with hooks and loops, is used to keep said ergonomic strap secured to the wrist during use, or assembled during storage; and a fourth strap having a zone commensurate with a width of a palm of a user and being made of a durable and flexible material with rough, opposite/external sides; said fourth strap having one end inserted between and stitched to said first and said third straps; said fourth strap configured to be positioned with respect to said first strap as to be, during a spiral wounding about a weight lifting bar, engageable by a thumb and a juxtapositioned index finger of a user, a position which corresponds to an inclination of $\alpha \approx 45$ degrees of said fourth strap with respect to said first strap;

a thin, narrow, elastic band, being transversely positioned on said bottom rough surface of said first strap and having ends of the elastic band attached to said first strap, said elastic band being positioned in a zone corresponding to an intersection of said long zone and said short zone; wherein when said ergonomic strap is not in use and already assembled, an end of said fourth strap is inserted through and secured in a space available between said thin, narrow, elastic band and said bottom rough surface.

* * * * *